United States Patent [19]

Casanova et al.

[11] Patent Number: 4,592,209

[45] Date of Patent: Jun. 3, 1986

[54] DISPLAY COUNTER FOR FOOD PRODUCTS, REFRIGERATED BY FORCED VENTILATION

[75] Inventors: Giuseppe Casanova, Trichiana; Ivano De Zolt, Bribano, both of Italy

[73] Assignee: Costan S.p.A., Limana, Italy

[21] Appl. No.: 736,356

[22] Filed: May 21, 1985

[30] Foreign Application Priority Data

May 23, 1984 [IT] Italy ..... 21898/84[U]

[51] Int. Cl.[4] ..... A47F 3/04

[52] U.S. Cl. ..... 62/255; 62/256

[58] Field of Search ..... 62/255, 256

[56] References Cited

U.S. PATENT DOCUMENTS

| | | | |
|---|---|---|---|
| 2,207,586 | 7/1940 | Hill | 62/255 |
| 2,508,255 | 5/1950 | Hardin | 62/256 |
| 2,625,799 | 1/1953 | Brinkaeter | 62/256 X |
| 2,626,508 | 1/1953 | Bently | 62/256 |
| 2,955,438 | 10/1960 | Thompson | 62/256 |
| 3,324,783 | 6/1967 | Hickox | 62/256 |
| 3,543,532 | 12/1970 | Gatton et al. | 62/256 |
| 4,458,501 | 7/1984 | Kooy | 62/256 |

FOREIGN PATENT DOCUMENTS

| | | |
|---|---|---|
| 631681 | 2/1947 | United Kingdom . |
| 722716 | 12/1951 | United Kingdom . |
| 1414743 | 2/1973 | United Kingdom . |

*Primary Examiner*—Lloyd L. King

*Attorney, Agent, or Firm*—Robbins & Laramie

[57] ABSTRACT

A refrigerated display counter has an interspace between an insulated tub-shaped cabinet and an inner tank forming a display surface. A cold air distribution duct provides for cold air flow over the display surface. An opening is provided in the cold air distribution duct, below the display surface level and deflector means are mounted in proximity to the opening for deflecting part of the cold air flow into the interspace.

4 Claims, 2 Drawing Figures

DISPLAY COUNTER FOR FOOD PRODUCTS, REFRIGERATED BY FORCED VENTILATION

This invention has as its object a display counter for food products of the kind comprising a tank, an inner tank with a floor defining a display surface disposed within the said tank, an interspace between the tank and the said floor, and a cold air distribution duct connected to a refrigeration unit and opening into the said inner tank onto the said display surface.

In counters of the said kind it is especially important that refrigeration of the foodstuffs, distributed upon the display surface shall be, as far as possible, homogeneous.

A widely used solution in known refrigerated display counters is to maintain a forced circulation of cold air flowing over the display surface of the said counters, so that it flows over and cools the foodstuffs distributed upon the display surface.

The cold air is emitted from small openings or orifices disposed above the display surface, and, in its passage over the food products to be cooled it is deflected variably by the said products, thus bringing about a non-homogeneous heat exchange, particularly due to the "blocking action" of the merchandise over which the air passes.

A known solution for overcoming this disadvantage provides for equipping the floor of the inner tank, which forms the display surface, with an associated coil or similar circuit for the passage of coolant gas.

This coil is connected in series with a refrigerating unit and it thus causes sub-cooling of the display surface.

The disadvantages arising from this, over and above the high cost of this embodiment, are mainly associated with the difficulty and complexity of connecting the coil to the circuit of the refrigerating unit, particularly when a display surface is required which can be oriented in relation to the tank, and with the excessively low temperature of the said display surface, as a result of which sheets of ice can be formed, possibly leading to partial freezing of the food products displayed.

The object of the invention is to provide a refrigerated display counter which will make it possible to overcome all the disadvantages referred to with reference to the prior art.

This object is achieved by the display counter according to the invention which is characterised in that it comprises an opening in the said cold air distribution duct which defines a passage in fluid communication with the interspace between the tank and the floor of the inner tank and deflector members in proximity to the said opening for feeding the said cold air into the said interspace.

The characteristics and advantages of the invention will become clearer from the detailed description of a preferred but not exclusive embodiment of a refrigerated display counter, illustrated by way of non-limiting example, in the appended drawings, in which.

Figure 1:
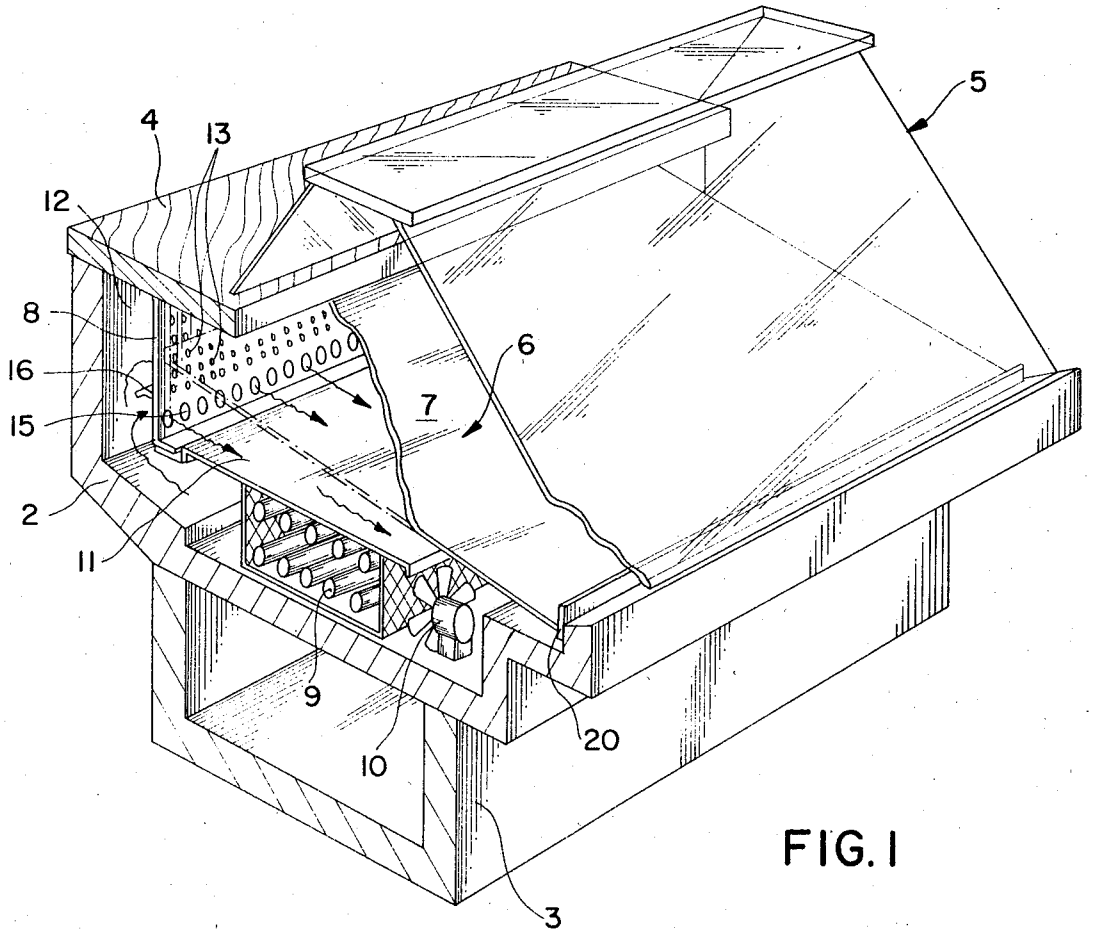
FIG. 1 is a partial perspective view of a display counter according to the invention.
Figure 2:
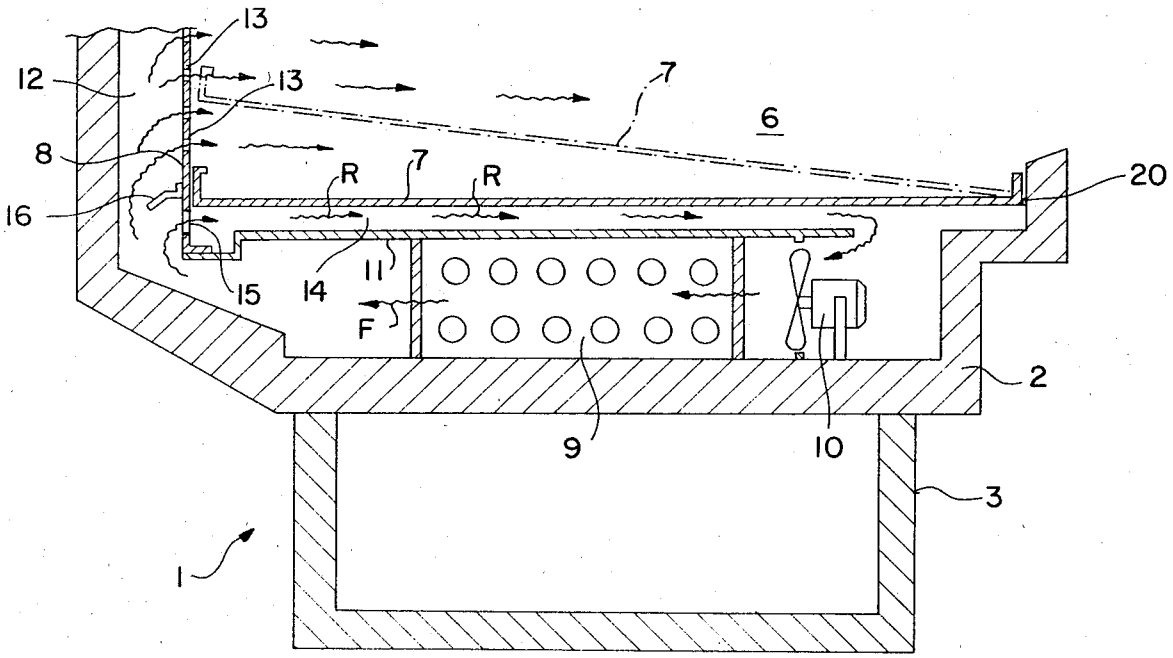
FIG. 2 is a sectional view of the same counter illustrating diagrammatically the characteristics of the invention.

In the example illustrated with reference to the appended drawings, the refrigerated display counter according to the invention is designated generally 1 and comprises a tank 2 resting on a base 3; the tank 2 is made of insulating material and has above it a shelf 4 extending predominantly longitudinally, disposed on the "server" side of the counter 1, and a glass window 5 disposed on the "customer" side of the said counter and openable on the "server" side. The terms "customer" side and "server" side are intended to mean the side of the counter which is turned, when the counter is installed in a shop, towards the customer, and the opposite side, respectively.

Within the tank 2 there is mounted an inner tank 6 including a floor 7 upon which a display surface for food products is defined, on the side facing the window 5, and further including a rear wall 8 on the side corresponding to the server side of the counter 1. The inner tank 6 is spaced from the tank 2, more particularly the floor 7 has below it a refrigeration unit 9 comprising one or more evaporator units of a refrigeration circuit, not shown, and corresponding electric fans 10.

The refrigeration unit 9 has above it a casing 11 connected at one end to the said wall 8 and delimiting with it, in cooperation with the tank 2, a cold air distribution duct 12, the forced circulation of this air being effected by the electric fans 10.

In the wall 8 there are a plurality of holes 13 through which the cold air circulating in the duct 12 flows onto the display surface formed by the floor 7 of the inner tank 6.

The floor 7, the casing 11 and the wall 8 define an interspace 14 between the tank 2 and the inner tank 6; a series of holes 15 in the wall 8 forms a fluid communication passage between the duct 12 and the interspace 14. The holes 15 have above them a deflector member 16 extending into and partially affecting the duct 12 so as to divert part of the flow of cold air circulating in the said duct through the holes 15 into the interspace 14.

The deflector member 16 is provided with means for varying the delivery of air through the holes 15 achieved, for example, by the pivoting of the deflector member 16 on the wall 8, so that the deflector member 16 can be oriented within the duct 12 in order to vary its degree of obstruction upstream of the holes 13 and consequently the flow of cold air circulating in the interspace 14.

The floor 7 of the inner tank 6 is mounted rotatably on the tank 2 at the customer side of the counter 1, for example by hinged support means 20; on the opposite side it is connected to the wall 8 in an adjustable position by screws, brackets, angle pieces or like conventional accessories, not illustrated.

The operation of the refrigerated display counter according to the invention is as follows: by means of the ventilator fans 10 a forced circulation of air is induced through the refrigerator unit 9 and thence passed into the duct 12 in the direction of the arrow F; the air flows into the rising section of the duct 12 and is partly diverted by the deflector member 16 and then flows through the holes 15 into the interspace 14 as indicated by the arrows R, whilst the remainder of the air continues in the duct and thence overflows through the holes 13, onto the display surface of the floor 7.

The food products arranged on the floor 7 are therefore cooled by the air overflowing from the holes 13 as well as by contact with the display surface cooled by the air circulating in the interspace 14; it should also be remarked that, upon variation of the orientation of the floor 7 relative to the tank by moving its point of connection to the wall 8, for example for a different display of goods arranged on the said floor 7, a different number of the holes 13 will communicate with the interspace 14, thus increasing the delivery of air circulating below the floor of the inner tank 6.

Adjustment of the delivery of air into the interspace 14 is possible by orientation of the deflector member 16 in the duct 12.

The invention thus achieves its proposed object together with numerous other advantages, among which must be noted the possibility of orienting the display surface entirely independently of the refrigeration unit, improved heat exchange with the goods displayed, both by conduction and by convection, as well as the structural simplicity and economical construction of a display counter having the above described characteristics.

We claim:

1. A refrigerated display counter comprising a tank, an inner tank, with a floor defining a display surface, disposed within the said tank, an interspace between the tank and the said floor, a cold air distribution duct connected to a refrigeration unit and opening into the said inner tank onto the said display surface, characterised in that it includes an opening in the said cold air distribution duct in fluid communication with the said interspace, and deflector members in the said duct, disposed in proximity to the said opening, said floor being rotatably supported along one of its sides and being adjustably positionable along an opposite side within the said inner tank.

2. A display counter according to claim 1, characterised in that it includes, in the said duct, means for varying the delivery of cold air through the said opening.

3. A display counter according to claim 1, characterised in that the said floor delimits the said distribution duct, and in which holes are made for the distribution of cold air onto the display surface.

4. A refrigerated display counter comprising:

a tank having a display side;

an inner tank including a display floor defining a display portion thereabove, disposed within said tank;

an interspace between the tank and the display floor;

a cold air distribution duct connected to a refrigeration unit and opening into the display portion of the inner tank, the duct having a plurality of openings therein in fluid communication with the interspace and the display portion, and deflector members within said duct disposed in proximity to the openings in communication with the interspace for regulating the flow of cold air thereto, and wherein said floor is rotatably supported along one of its sides adjacent the display side and being angularly adjustably positionable along an opposite side thereof within said inner tank in correspondence with the duct in which the openings are formed, for the distribution of cold air into the display portion in accordance with the angular position of said display floor.

* * * * *